US005686783A

United States Patent [19]

Stark

[11] Patent Number: 5,686,783

[45] Date of Patent: Nov. 11, 1997

[54] CEMENTLESS ELECTRICAL LAMP-BASE COMBINATION

[75] Inventor: Roland Stark, Wellheim, Germany

[73] Assignee: Patent-Treuhand-Gesellschaft fuer elektrische Gluehlampen mbH, Munich, Germany

[21] Appl. No.: 634,510

[22] Filed: Apr. 18, 1996

[30] Foreign Application Priority Data

Jul. 4, 1995 [DE] Germany ..... 195 24 385.4

[51] Int. Cl.[6] ..... H01K 1/46

[52] U.S. Cl. ..... 313/318.01; 313/318.07; 313/318.09

[58] Field of Search ..... 313/318.01, 318.02, 313/318.05, 318.07, 318.09, 624, 625, 318.1; 439/611, 612, 613, 614, 615, 616, 617, 618, 619

[56] References Cited

U.S. PATENT DOCUMENTS

| | | | |
|---|---|---|---|
| 3,256,507 | 6/1966 | Ackerman | 439/619 |
| 3,256,508 | 6/1966 | Malm | 439/619 |
| 3,515,931 | 6/1970 | Takakuwa | 313/318.02 X |
| 3,961,216 | 6/1976 | Edwards | 313/318.07 X |
| 5,495,138 | 2/1996 | Behr et al. . | |

FOREIGN PATENT DOCUMENTS

| | | |
|---|---|---|
| 0 643 255 | 3/1995 | European Pat. Off. . |
| 40 37 964 | 6/1992 | Germany . |

*Primary Examiner*—Hezron E. Williams
*Assistant Examiner*—Daniel S. Larkin
*Attorney, Agent, or Firm*—Frishauf, Holtz, Goodman, Langer & Chick, P.C.

[57] ABSTRACT

To retain an electric lamp bulb (1), without cement, in a base sleeve (2), and provide a strain relief for insulated connection leads (6, 7) extending from the lamp, the base is formed of a metallic base sleeve having two opposite side walls (**2*a*, 2*b*); a base block formed of two parts (3*a*, 3*b*) is located within the base sleeve, the parts being essentially F-shaped defining recesses which, when the parts are placed against each other with the recesses facing each other, form through openings (4, 5) within which the electrical connection leads (6, 7) are located. The parts are slightly smaller than the width of the base sleeve, and, upon deformation of the side walls of the base sleeve, for example by forming inwardly projecting dimples (9), the parts are shifted against each other and the insulated electrical connection leads are thereby clamped in the through openings, providing strain relief. Preferably, the region of the parts in the openings is formed with projecting clamping ridges (10, 11) which can further engage with the insulation jacket of the leads (6, 7**). The sleeve is made of metal, and the parts of the base block, preferably, of ceramic.

10 Claims, 2 Drawing Sheets

CEMENTLESS ELECTRICAL LAMP-BASE COMBINATION

FIELD OF THE INVENTION.

The present invention relates to the combination of an electric lamp and a base, in which the base and the lamp bulb are attached together without use of a cement or the like and, more particularly, to low-voltage, medium-power halogen incandescent lamp bulb-base combinations.

BACKGROUND.

Bulbs of small electric lamps can be retained in bases by extending connection leads from the bulbs into the base structure. German Patent DE 40 37 964 C2 describes a small electric lamp with a strain relief for an attachment cable, which is formed by a clamping wedge, located between the connecting cable and a recess in a base. It has been found that this strain relief places a stress on the attachment cable at one side only which, upon assembly, may lead to undesired movement of the connecting cable, particularly twisting movement. U.S. Pat. No. 5,495,138 (to which European 0 643 255 corresponds assigned to the Assignee of the present application, the disclosure of which is hereby incorporated by reference, discloses an electrical lamp with a strain relief for a connecting cable, which is formed by crimped lead-through rivets. The lead-through rivets are threaded on a connecting cable and then crimped and embedded in conically converging wire passage openings. This strain relief works well, but it has been found comparatively expensive to make.

THE INVENTION.

It is an object of the present invention to provide an electrical lamp bulb-base combination, devoid of cement, which has a simple, easily made, and reliable strain relief for the current supply leads incorporated therein.

Briefly, the strain relief is incorporated in the base and requires no additional constructional elements. In accordance with a feature of the invention, the base is formed as a sleeve, preferably of essentially rectangular cross-section, which has oppositely located side walls. A two-part base block is located within the base sleeve, such that one of each of the parts is located against one of the side walls of the sleeve. The two parts are formed with at least partially generally semicircular recesses and, when assembled together with the recesses facing each other, define current supply lead openings. By engagement of the respective parts with the respective side walls, for example by selectively punching the side walls inwardly, the alignment of the recesses in the parts is shifted, thereby clamping the cables in the openings. The two parts of the base block, in accordance with the invention, are thus shifted against each other after initial assembly. The relative position of the two parts determines the size or, respectively, the diameter of the lead-through openings for the current supply leads and, upon relative shifting, the current supply leads are securely clamped in the then distorted lead-through openings. The clamping arrangement can easily be formed by deforming the side walls of the base sleeve, such that one side wall presses against one of the base block parts in the direction to the other, and the other side wall presses the other base block parts in the direction towards the first side wall. Preferably, shifting of the base block parts, and providing force against the base block part and ensuring the clamping of the current supply leads is obtained by punching the side walls to form inwardly directed dimples. The base block parts may also be formed with small clamping ridges within the openings, in order to improve the clamping effect on the current supply leads.

In accordance with another preferred feature of the invention, the two base block parts are identical in shape, which substantially simplifies manufacture. The base sleeve is, preferably, formed at the end with two holding flaps, or lugs, attached to the respective side walls and, after assembly, folded over to hold the base block assembly of the two base block parts within the base sleeve. Abutment dimples, punched into the base sleeve, which typically is of metal, ensure proper axial positioning of the base block within the base assembly.

DRAWINGS.

FIG. 1 is a partly exploded perspective view of the base of the lamp, showing the base block parts and, in fragmentary representation, the end portion of a bulb of a lamp;

FIG. 2 is an end view of the lamp base, partly in section, before relative shifting of the respective base block parts, immediately after assembly of the base to the lamp; and FIG. 3 is a view similar to FIG. 2, partly broken away and in section, and illustrating the position of the base block parts after deformation of the side walls, with the lead-through conductors clamped in the base, and showing holding flaps angled-over to retain the base block within the base sleeve.

DETAILED DESCRIPTION.

The invention will be described in connection with a cementless lamp bulb-base combination in which the lamp is a low-voltage halogen incandescent lamp of a nominal power rating of about 200 W with a nominal rated current of 6.6 A. Such a lamp, operating at, for example, about 30 V, is used for flash illumination of aircraft landing strips. Of course, the connection is also suitable for other types of lamps.

Figure 1:
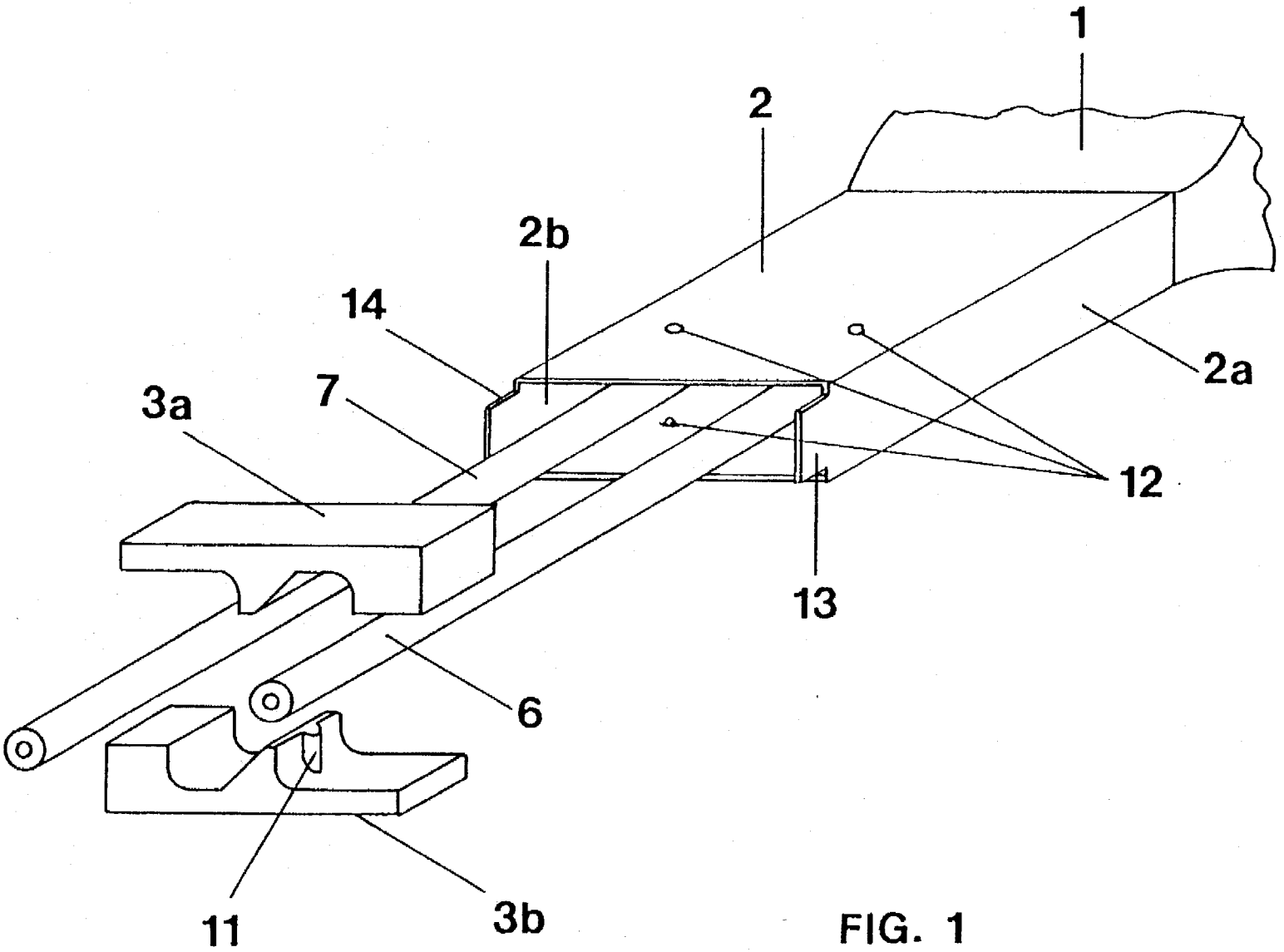
Figure 2:
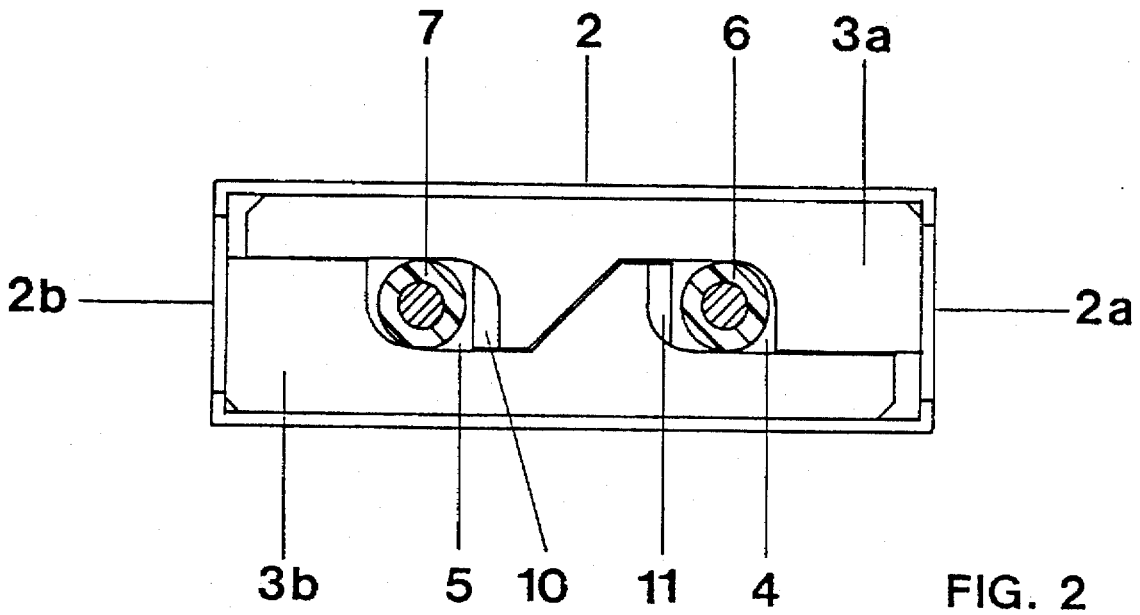
Figure 3:
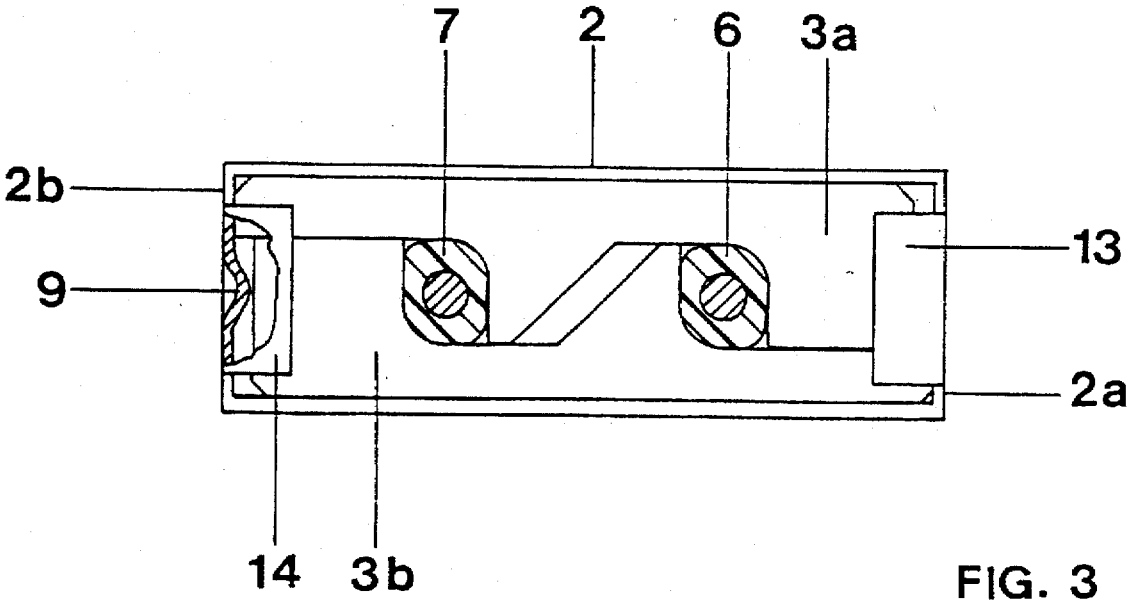

The lamp has a lamp bulb 1 and a base formed by a metallic base sleeve 2 having a base block located therein, composed of two base block parts 3*a*, 3*b*. The metallic base sleeve 2, in cross-section, is rectangular and has two open ends. The rectangular base sleeve has two narrow, oppositely located side walls 2*a*, 2*b*. The base block is formed by two identically, essentially F-shaped halves 3*a*, 3*b*, made of electrically insulating ceramic. The two F-shaped base block halves 3*a*, 3*b* are so inserted into the base sleeve 2 that the projecting portions interfit with each other and leave two lead-through openings 4, 5 between the projecting, and end portions for current supply leads 6, 7, formed by an insulating jacket about conductive wires. The base block halves 3*a*, 3*b* completely fill the height dimension of the base sleeve 2. A small play, however, is left between the base block halves 3*a*, 3*b* and the narrower side walls 2*a*, 2*b* of the sleeve 2. The dimensions of the base block halves 3*a*, 3*b* in transverse direction are slightly less than the internal width of the base sleeve 2 or, in other words, the spacing of the side walls 2*a*, 2*b*, so that the block halves 3*a*, 3*b* can be shifted in horizontal direction—with respect to FIG. 1—for slight distances. Horizontal shifting of the base block halves with respect to each other changes the dimension or, size, respectively, of the leadthrough openings 4, 5, compare FIG. 2 and FIG. 3. Inwardly directed dimples 9, formed on the respective side walls 2*a*, 2*b*, shift the base block halves 3*a*, 3*b* with respect to each other in opposite direction, thereby constricting the size of the leadthrough openings 4, 5, so that the current supply leads 6, 7 are clamped in the openings 4, 5 and securely held therein in clamped position. The inwardly extending dimples, or deformations 9, eliminate the slight play between the base halves 3*a*, 3*b* and the side walls 2*a*, 2*b*. The side walls 2*a*, 2*b*, with their dimples 9, then tightly engage the base block halves 3*a*, 3*b* and, thereby, form a clamp engagement and clamp connection and clamped seat of the current supply leads 6, 7 within the openings 4, 5.

Before constriction, the leads 6, 7 can be easily threaded through sleeve 2, and the parts 3*a*, 3*b* placed over the leads and introduced into the sleeve 2.

The current supply leads 6, 7 in part extend through the sleeve 2 and are welded to respective electrodes, not shown, gas-tightly sealed through and extending from the lamp bulb 1. These electrodes are connected, as well known, with filaments located within the bulb 1 (not shown). The electrodes and/or the connecting leads 6, 7 are surrounded by an insulating jacket and formed as connecting cables.

In accordance with a feature of the invention, two small clamping ribs 10, 11 (FIG. 2), formed on the respective block halves 3*a*, 3*b*, increase the clamping effect of block halves 3*a*, 3*b* when shifted with respect to each other.

Axial position of the block halves 3*a*, 3*b* is ensured by four internally extending dimples or projections 12 on the base sleeve 2; in the outward direction, two angled-over attachment flaps, or lugs, 13, 14 retain the block parts 3*a*, 3*b* within the sleeve 2. The engagement dimples 12 determine the projection depth of the block halves 3*a*, 3*b* in the base sleeve 2; the flaps 13, 14 prevent the halves 3*a*, 3*b* from falling out of the base sleeve 2.

Various changes and modifications may be made within the scope of the inventive concept.

What I claim is:

1. Electrical lamp bulb-base combination, and means for retaining the lamp bulb (1) in the base devoid of cement comprising a base sleeve (2) having two opposite side walls (2*a*, 2*b*);

a base block (3*a*, 3*b*) located within the sleeve and formed with connection lead openings (4, 5);

electrical connection leads (6, 7) passing through the openings (4, 5) in the base block; and a strain relief integrated into the base block wherein, in accordance with the invention, the base block comprises two parts (3*a*, 3*b*) located within said base sleeve (2), one of each part being located against one of said side walls (2*a*, 2*b*), said base block parts being dimensioned and positioned for relative sliding movement of said two parts towards each other, said two parts being formed with at least one partly generally semi-circular recess and, when assembled together with the recesses facing each other, defining said connection lead-through openings (4, 5) and, by engagement of the respective part (3*a*, 3*b*), with respect to said side walls (2*a*, 2*b*) against which the respective parts are located, clampingly engaging the connection leads (6, 7) in the through openings (4, 5) and thereby forming said strain relief.

2. The lamp of claim 1, including inwardly projecting dimples (9) formed in the respective side walls (2*a*, 2*b*), wherein at least one dimple in a first side wall (2*a*) engages one part (3*a*) of said base block parts, and at least one other dimple of a second side wall (2*b*) engages a second base block part (3*b*) to provide clamping engagement, and hence strain relief, of said electrical connection leads (6, 7) within said openings (4, 5).

3. The lamp of claim 1, further including clamping ridges (10, 11) formed on each of said two base block parts (3*a*, 3*b*) and facing inwardly of said recesses.

4. The lamp of claim 1, wherein said two base block parts (3*a*, 3*b*) are essentially identical.

5. The lamp of claim 1, further including means (12, 13, 14) for retaining said two base block parts (3*a*, 3*b*) within said base sleeve (2) formed on said base sleeve (2).

6. The lamp of claim 5, wherein said retaining means (12, 13, 14) comprise inwardly projecting dimples (12) projecting inwardly from said base sleeve (2) and forming abutment projections for said base block (3*a*, 3*b*); and partly closing flaps or lugs (13, 14) formed on said sleeve at an end remote from the lamp bulb (1) fitted on said sleeve, angled and projecting over said base block in the sleeve (2).

7. The lamp of claim 1, wherein the base sleeve (2) is made of metal.

8. The lamp of claim 1, wherein said base block parts (3*a*, 3*b*) comprise electrically insulating ceramic.

9. The lamp of claim 1, wherein said electrical connection leads (6, 7) comprise electrical connection wires and an insulating jacket, and said base block parts clamp and deform said jacket within said recesses.

10. The lamp of claim 3, wherein said electrical connection leads (6, 7) comprise electrical connection wires and an insulating jacket, and said base block parts clamp and deform said jacket within said recesses.

* * * * *